US009116485B2

(12) United States Patent
Yasuda et al.

(10) Patent No.: US 9,116,485 B2
(45) Date of Patent: Aug. 25, 2015

(54) TEMPERATURE SENSOR AND FRAME CONFIGURATION FOR AN IMAGE FORMING APPARATUS

(71) Applicants: Masaki Yasuda, Nogya (JP); Noboru Suzuki, Komaki (JP)

(72) Inventors: Masaki Yasuda, Nogya (JP); Noboru Suzuki, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/032,536

(22) Filed: Sep. 20, 2013

(65) Prior Publication Data

US 2014/0086645 A1 Mar. 27, 2014

(30) Foreign Application Priority Data

Sep. 21, 2012 (JP) ..... 2012-207848

(51) Int. Cl.
*G03G 15/20* (2006.01)
*G03G 15/00* (2006.01)

(52) U.S. Cl.
CPC ..... *G03G 15/5045* (2013.01); *G03G 15/2028* (2013.01); *G03G 2215/0141* (2013.01)

(58) Field of Classification Search
CPC ..... G03G 15/2028; G03G 15/5045; G03G 2215/0141
USPC ..... 399/322, 400
See application file for complete search history.

(56) References Cited

U.S. PATENT DOCUMENTS

| | | | | | |
|---|---|---|---|---|---|
| 3,998,584 | A | * | 12/1976 | Wada et al. | 432/60 |
| 5,142,339 | A | * | 8/1992 | Kasahara et al. | 399/322 |
| 5,162,634 | A | * | 11/1992 | Kusaka et al. | 219/216 |
| 5,903,810 | A | * | 5/1999 | Adachi | 399/328 |
| 6,252,207 | B1 | * | 6/2001 | Cahill et al. | 219/497 |
| 7,013,099 | B2 | * | 3/2006 | Shirakata | 399/92 |
| 7,027,075 | B2 | * | 4/2006 | Yokoi | 347/156 |
| 7,194,221 | B2 | * | 3/2007 | Kim et al. | 399/92 |
| 7,555,233 | B2 | * | 6/2009 | Shiobara et al. | 399/69 |
| 7,778,582 | B2 | * | 8/2010 | Miki et al. | 399/329 |

(Continued)

FOREIGN PATENT DOCUMENTS

| | | | | |
|---|---|---|---|---|
| JP | 05134572 | A | * | 5/1993 |
| JP | 08044230 | A | * | 2/1996 |

(Continued)

OTHER PUBLICATIONS

Machine translation of JP 08044230 A.*

*Primary Examiner* — David Bolduc
(74) *Attorney, Agent, or Firm* — Banner & Witcoff, Ltd.

(57) ABSTRACT

In an image forming apparatus, a heating member for heating a recording sheet and a pressuring member disposed below the heating member are supported by a fixing unit frame. A noncontact temperature sensor disposed facing the heating member detects a temperature of the heating member without contacting the heating member. An upper frame covers an upper portion of the heating member and an upstream portion of the heating member in a conveying direction of the recording sheet. A plate-shaped upper sheet guide protrudes upstream in the conveying direction from an upstream end of the upper frame and extends in a width direction perpendicular to the conveying direction and to a vertical direction. The upper sheet guide and a lower sheet guide disposed below and facing the upper sheet guide the recording sheet in the conveying direction toward the heating member and the pressuring member.

13 Claims, 5 Drawing Sheets

(56) References Cited

U.S. PATENT DOCUMENTS

| | | | | |
|---|---|---|---|---|
| 2007/0008396 | A1* | 1/2007 | Shimizu | 347/156 |
| 2007/0217836 | A1* | 9/2007 | Sone et al. | 399/328 |
| 2009/0123201 | A1* | 5/2009 | Ehara et al. | 399/328 |
| 2009/0214250 | A1* | 8/2009 | Mikuni | 399/92 |
| 2009/0238596 | A1* | 9/2009 | Shiobara et al. | 399/69 |
| 2009/0297242 | A1* | 12/2009 | Kanematsu | 399/400 |
| 2010/0028036 | A1* | 2/2010 | Aratachi et al. | 399/69 |
| 2011/0026991 | A1* | 2/2011 | Izawa et al. | 399/336 |
| 2011/0206424 | A1* | 8/2011 | Tagami | 399/322 |
| 2011/0280634 | A1 | 11/2011 | Yoshimura et al. | |
| 2012/0076510 | A1* | 3/2012 | Mizuno et al. | 399/12 |
| 2012/0087693 | A1* | 4/2012 | Yamaguchi et al. | 399/92 |
| 2012/0224869 | A1* | 9/2012 | Yamada | 399/33 |
| 2013/0183069 | A1* | 7/2013 | Sakai et al. | 399/322 |
| 2013/0302073 | A1* | 11/2013 | Takeuchi | 399/328 |
| 2014/0056608 | A1* | 2/2014 | Miura | 399/92 |

FOREIGN PATENT DOCUMENTS

| | | | | |
|---|---|---|---|---|
| JP | 2001175152 | A | * | 6/2001 |
| JP | 2005-338309 | A | | 12/2005 |
| JP | 2007057758 | A | * | 3/2007 |
| JP | 2010-204551 | A | | 9/2010 |
| JP | 2011-242428 | A | | 12/2011 |

* cited by examiner

TEMPERATURE SENSOR AND FRAME CONFIGURATION FOR AN IMAGE FORMING APPARATUS

CROSS REFERENCE TO RELATED APPLICATION

This application claims priority from Japanese Patent Application No. 2012-207848, filed on Sep. 21, 2012, the entire disclosure of which is incorporated herein by reference.

BACKGROUND OF THE INVENTION

1. Field of the Invention

The present invention relates to an image forming apparatus comprising a noncontact temperature sensor configured to detect the temperature of a heating member of a fixing unit without contacting the heating member.

2. Description of Related Art

A known image forming apparatus, e.g., a laser printer and a digital copier, comprises a noncontact temperature sensor, e.g., a noncontact thermistor, configured to detect the temperature of a heating member of a fixing unit.

In such a fixing unit, because the noncontact temperature sensor detects the temperature of the heating member indirectly through an air layer between the noncontact temperature sensor and the heating member, air flow in the air layer, if generated, may prevent the noncontact temperature sensor from detecting the temperature stably. This may result in inaccurate control of the temperature of the heating member.

SUMMARY OF THE INVENTION

Therefore, a need has arisen for an image forming apparatus which allows a noncontact temperature sensor to stably detect the temperature of a heating member of a fixing unit.

According to an embodiment of the invention, an image forming apparatus comprises a heating member configured to heat a recording sheet, a pressuring member disposed below the heating member and configured to press the recording sheet against the heating member, a fixing unit frame supporting the heating member and the pressuring member, a noncontact temperature sensor disposed in the fixing unit frame to face the heating member and configured to detect a temperature of the heating member without contacting the heating member, an upper frame covering an upper portion of the heating member and an upstream portion of the heating member in a conveying direction of the recording sheet, an upper sheet guide which has a plate shape, protrudes upstream in the conveying direction from an upstream end of the upper frame, and extends in a width direction perpendicular to the conveying direction and to a vertical direction, and a lower sheet guide disposed below and facing the upper sheet guide. The upper sheet guide and the lower sheet guide are configured to guide the recording sheet in the conveying direction toward the heating member and the pressuring member.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

Embodiments of the invention and their features and technical advantages may be understood by referring to FIGS. 1-5, like numerals being used for like corresponding parts in the various drawings.

In the following description, the expressions "front", "rear", "upper (up)", "lower (down)", "right", and "left" are used to define the various parts when a color printer 1, is disposed in an orientation in which it is intended to be used.

<General Structure of Color Printer>

Figure 1:
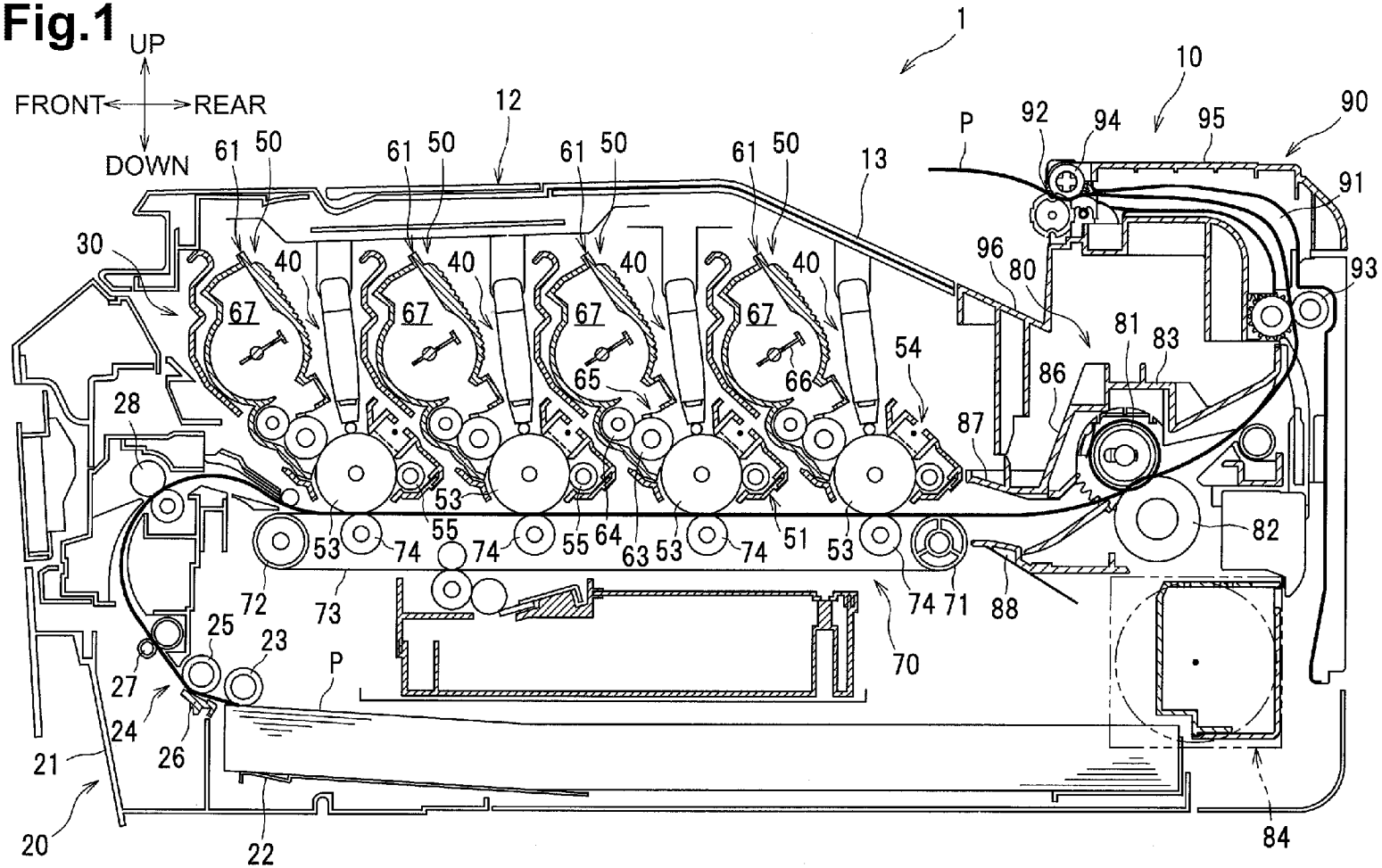
FIG. 1 is a schematic perspective view of an image forming apparatus, e.g., a color printer, according to an embodiment of the invention.

As shown in FIG. 1, the color printer 1 comprises a sheet feed unit 20, an image forming unit 30, a fixing unit 80, a sheet discharge unit 90, and a main frame 10 accommodating these units. A top cover 12 is disposed at an upper portion of the main frame 10 and configured to pivot about the rear side thereof so as to open and close vertically relative to the main frame.

The sheet feed unit 20 is disposed at the bottom in the main frame 10 and comprises a feed tray 21 for accommodating recording sheets P, a sheet lifting plate 22, a feed roller 23, a separation roller 25 disposed along a conveying path 24 of the recording sheet P, a separation pad 26, a sheet powder removing roller 27, and a registration roller 28.

The sheet lifting plate 22 lifts the recording sheets P in the feed tray 21 toward the feed roller 23, and the feed roller 23 feeds the recording sheets P. The separation roller 25 and the separation pad 26 separate the recording sheets one by one. After the sheet powder removing roller 27 collects a certain amount of sheet powder, the registration roller 28 feeds the recording sheet P to the image forming unit 30.

The image forming unit 30 comprises four light emitting diode (LED) units, four process cartridges 50, and a transfer unit 70. Each process cartridge 50 comprises a photosensitive drum cartridge 51 and a developing cartridge 61 which is removably attached to the photosensitive drum cartridge 51.

Each LED unit 40 is disposed above a corresponding photosensitive drum 53 and comprises, at a lower end thereof, a plurality of LEDs (light emitting diodes) arrayed in a left-right direction. LEDs of the LED unit 40 turn on and off based on image data to expose the surface of the photosensitive drum 53 to light. The LED units 40 are held by the top cover 12 so as to be separated from the respective photosensitive drums 53 when the top cover 12 is open.

The process cartridges 50 are disposed between the top cover 12 and the feed tray 21 and are arranged along a front-rear direction. The process cartridges 50 are replaceably attached to the main frame 10 when the top cover is open.

Each photosensitive drum cartridge 51 comprises the photosensitive drum 53, a charger 54, and a recovery roller 55. The recovery roller 55 collects toner which has not been transferred and remains on the photosensitive drum 53.

Each developing cartridge 61 comprises a developing roller 63, a supply roller 64, a blade 65, an agitator 66, and a storage 67 for storing an developing agent, e.g., a positive charge toner.

A transfer unit 70 is disposed between the feed tray 21 and the process cartridge 50 and comprises a drive roller 71, a driven roller 72, an endless conveying belt 73, and four transfer rollers 74. The conveying belt 73 is stretched around the driven roller 71 and the driven roller 72. An outer face of the conveying belt 73 opposes the arranged photosensitive drums 53. The transfer rollers 74 are disposed inside the conveying belt such that each transfer roller 74 and the corresponding photosensitive drum 53 nip the conveying belt 73.

The fixing unit 80 is disposed behind the four process cartridges 50 of the image forming unit 30. The fixing unit 80 comprises a heating member, e.g., a heat roller 81, for heating the recording sheet P and a pressuring member, e.g., a pressure roller 82, for pressing the recording sheet P against the heat roller 81. The heat roller 81 and the pressure roller 82, which are main components of the fixing unit 80, are rotatably supported by the fixing unit frame 83.

The sheet discharge unit 90 is disposed behind the fixing unit 80. The sheet discharge unit 90 comprises a convey roller 93, a discharge roller 94, and a discharge unit frame 95 which rotatably supports the convey roller 93 and the discharge roller 94. The convey roller 93 conveys the recording sheet P conveyed from the fixing unit 80 to a discharge port 92 along a discharge path 91. The discharge roller 94 discharges the recording sheet P from the discharge port 92 onto the discharge tray 13. The discharge unit frame 95 and an upper cover 96 define the discharge path 91 therebetween.

In the image forming unit 30, after the charger 54 uniformly and positively charges the surface of the photosensitive drum 53, the LED unit 40 exposes the surface to light to form an electrostatic latent image, based on image data, on the photosensitive drum 53. The agitator 66 stirs the toner in the storage 67, and the supply roller 64 supplies the toner to the developing roller 63 which is applied with a developing bias. The toner enters between the developing roller 63 and a blade 65, and the developing roller 63 bears a thin layer of toner having a uniform thickness. When the developing roller 63 contacts the photosensitive drum 53, the toner is supplied from the developing roller 63 to the photosensitive drum 53. The electrostatic latent image is visualized and a toner image is formed on the photosensitive drum 53.

Then when the recording sheet P fed to the image forming unit 30 is conveyed between the photosensitive drum 53 and the conveying belt 73, the toner image formed on the photosensitive drum 53 is transferred onto the recording sheet P. The recording sheet P with the transferred toner image is conveyed to the fixing unit 80. When the recording sheet P passes between the heat roller 81 and the pressure roller 82, the toner image is thermally fixed, as an image, onto the recording sheet P. The convey roller 93 and the discharge roller 94 convey the recording sheet P with the image formed thereon along the discharge path 91 and discharge the recording sheet P from the discharge port 92 of the sheet discharging frame 95 onto the discharge tray 13.

<Detailed Structure of Fixing Unit>

Figure 2:
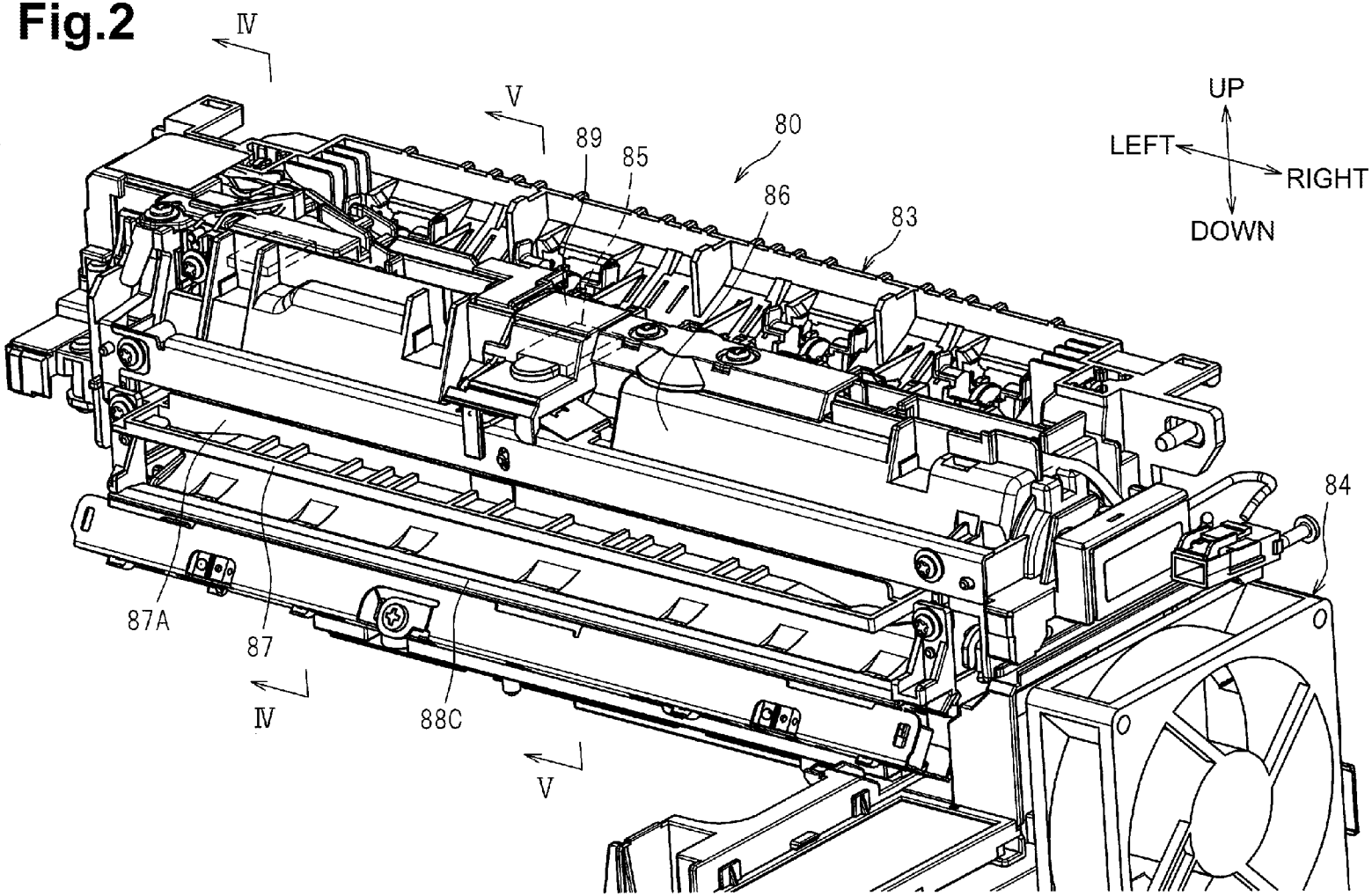
FIG. 2 is a perspective view of a fixing unit shown in FIG. 1.
Figure 3:
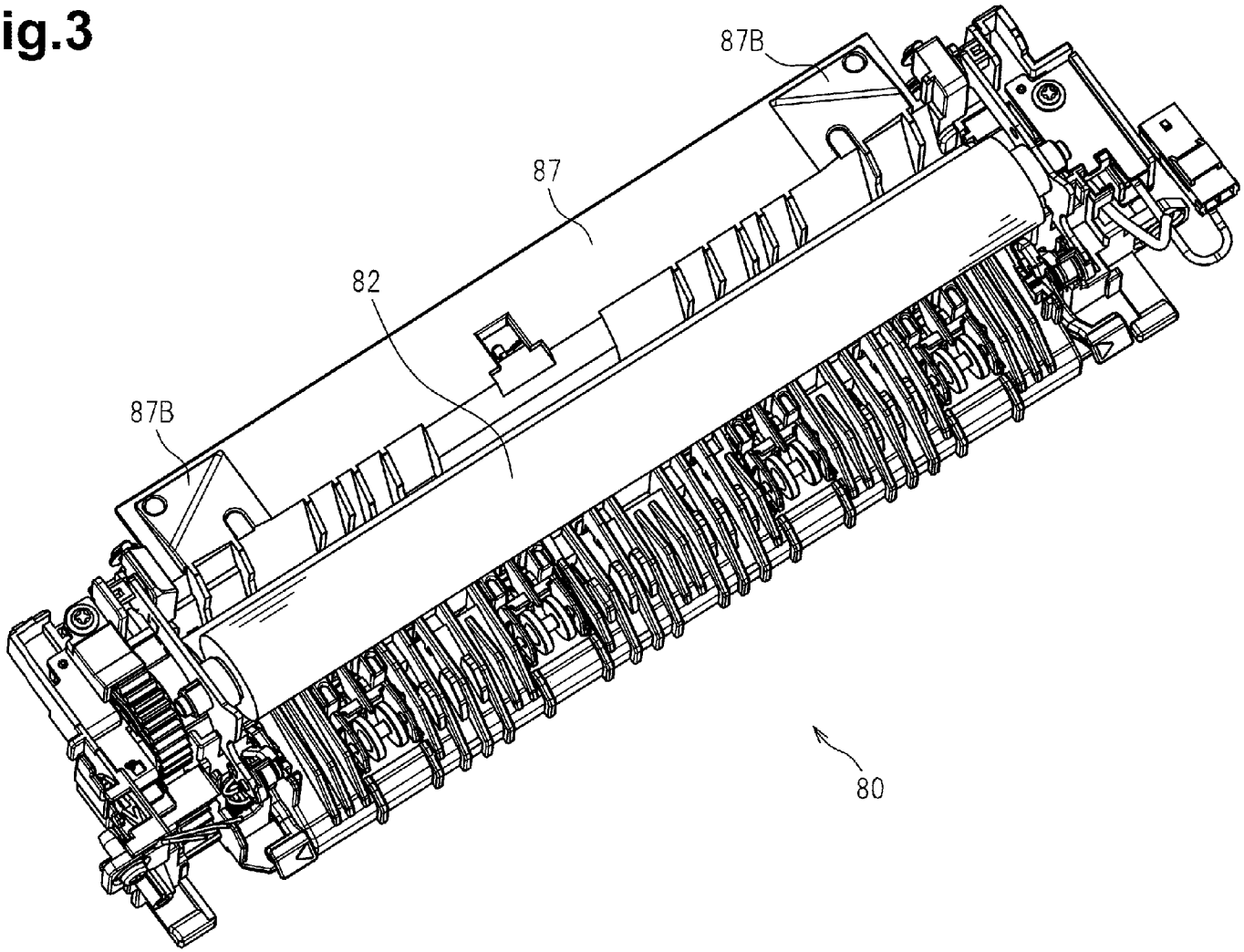
FIG. 3 is a perspective view of a lower side of the fixing unit shown in FIG. 2.
Figure 4:
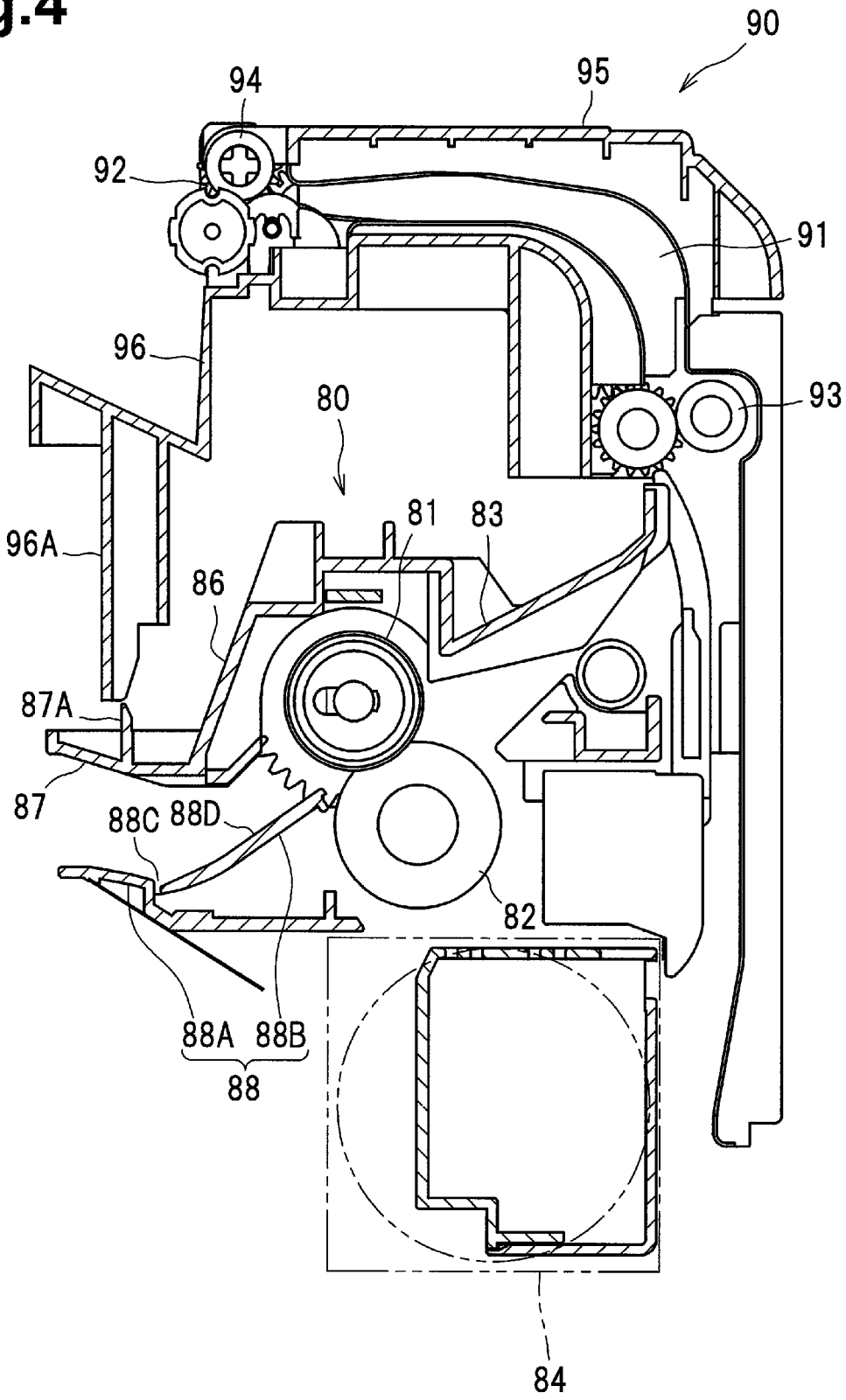
FIG. 4 is an enlarged cross-sectional view of the fixing unit taken along line IV-IV of FIG. 2.
Figure 5:
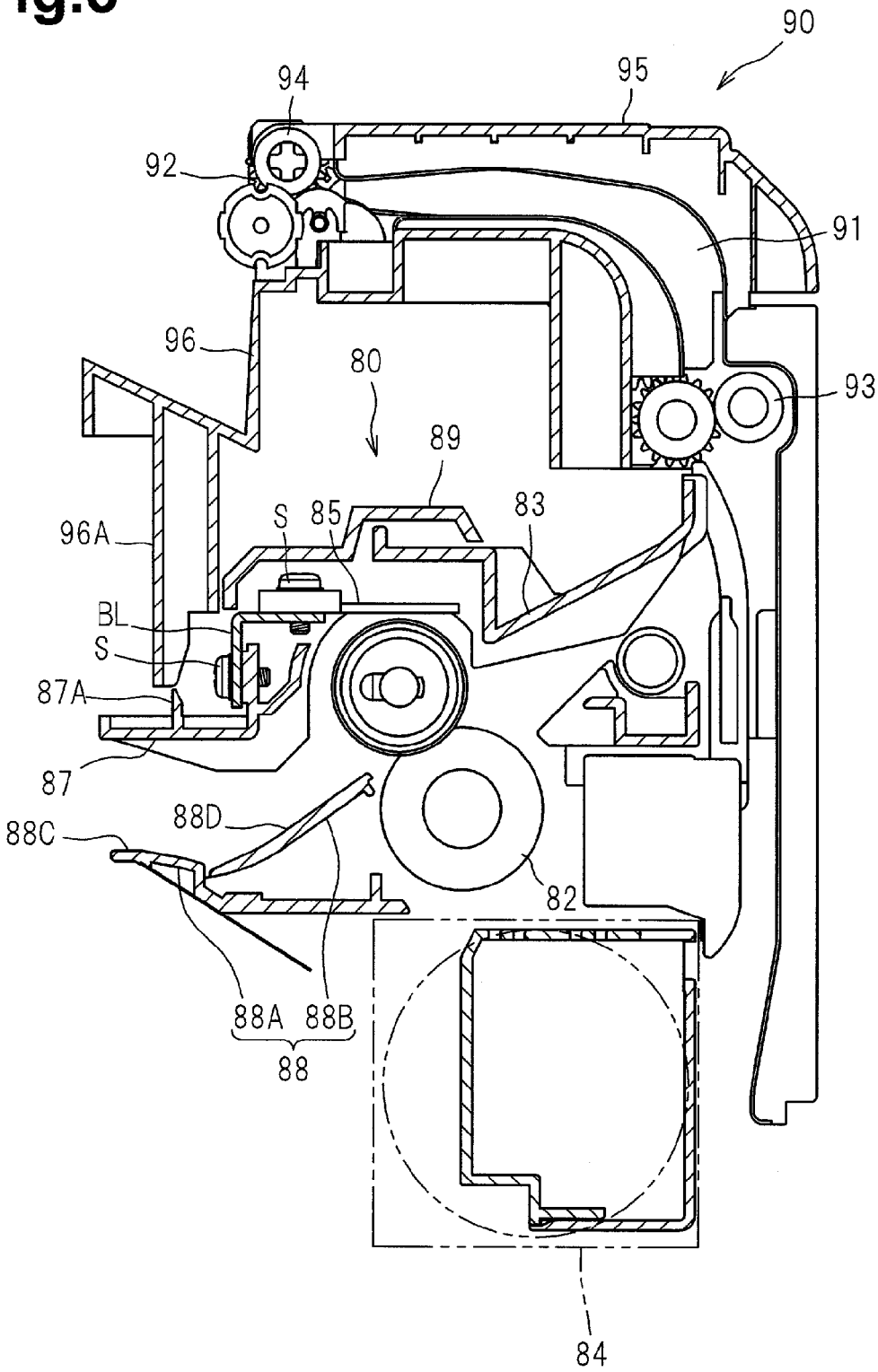
FIG. 5 is an enlarged cross-sectional view of the fixing unit taken along line V-V of FIG. 2.

As shown in FIGS. 2 and 3, the fixing unit 80 comprises a fixing unit frame 83 which is long in a width direction (left-right direction) perpendicular to a conveying direction of the recording sheet P. As shown in FIGS. 4 and 5, the fixing unit frame 83 rotatably supports the heat roller 81 and the pressure roller 82, which are main components of the fixing unit 80.

As shown in FIG. 2, a single exhaust fan 84 is disposed at a right end of the fixing unit frame 83 to cool the heat roller 81. A noncontact temperature sensor, e.g., a noncontact thermistor 85, is disposed at a central portion of the fixing unit frame 83 in the width direction to detect a surface temperature of the heat roller 81 without touching the heat roller 81.

The heat roller 81 comprises a cylindrical metal tube and a halogen heater (numeral omitted) disposed in the cylindrical metal tube. Opposite ends of the heat roller 81 in an axial direction thereof are rotatably supported by the fixing unit frame 83 through bearings (not shown). The pressure roller 82 is disposed diagonally downward and rearward of the heat roller 81.

The pressure roller 82 comprises a core bar and a relatively thick urethane rubber layer around the core bar and is configured to apply a predetermined nip pressure to the heat roller 81. Opposite ends of the pressure roller 82 are supported by an arm (not shown) which is swingably supported by the fixing unit frame 83. The arm is urged upward by a spring (not shown) such that the pressure roller 82 presses the heat roller 81 with a predetermined force.

As shown in FIG. 4, the fixing unit frame 83 comprises an upper frame 86, an upper sheet guide 87, a lower sheet guide 88, and a cover portion 89. The upper frame 86 covers an upper portion and a front portion of the heat roller 81. The upper sheet guide 87 has a plate shape and extends frontward from a front end of the upper frame 86. The lower sheet guide 88 is disposed below the upper sheet guide 87 to face the upper sheet guide 87. The cover portion 89 (FIG. 5) covers an upper portion of the noncontact thermistor 85.

As shown in FIG. 2, the exhaust fan 84 is disposed at a right end of the fixing unit frame 83. That is, the exhaust fan 84 is disposed at a right end portion of the heat roller 81 in the axial direction. As shown in FIGS. 4 and 5, the exhaust fan 84 is disposed below and slightly rearward of the heat roller 81.

In operation, the exhaust fan 84 takes air into the inside of the main frame 10 from the discharge port 92 at an upper portion of the sheet discharge unit 90, and exhausts the taken air out of a rear right, lower portion of the main frame 10. Consequently, air flow is generated inside the main frame 10 and the generated air cools the surroundings of the fixing unit 80.

The noncontact thermistor 85 is a semiconductor device capable to detect a surface temperature of the heat roller 81 without contacting the same. As shown in FIG. 5, the noncontact thermistor 85 is supported, at a position facing an upper face of the heat roller 81, by the fixing unit frame 83 through an L-shaped bracket BL.

A vertical piece of the L-shaped bracket BL is fixed to a portion of the upper frame 86 (FIG. 4) with a screw S, and the noncontact thermistor 85 is supported by a horizontal piece of the L-shaped bracket BL with a screw S. The cover portion 89, which is attached to a central portion of the fixing unit frame 83 in the width direction, covers an upper portion of the noncontact thermistor 85. The noncontact thermistor 85 is interposed between the cover portion 89 and the heat roller 81.

As shown in FIG. 4, the upper frame 86, which is a part of the fixing unit frame 83, covers the upper and front portions of the heat roller 81. The upper frame 83 extends on each side of the cover portion 89 along the width direction (left-right direction) of the fixing unit frame 83. The plate-shaped upper sheet guide 87 extends frontward from the front end of the upper frame 86.

The upper sheet guide 87 guides the recording sheet P in the conveying direction from an upstream (front) side thereof to a downstream (rear) side thereof. The upper sheet guide 87 extends in a width direction which is perpendicular to the conveying direction of the recording sheet P and to the vertical (up-down) direction, and is disposed frontward of the heat roller 81 and the pressure roller 82. The upper sheet guide 87 protrudes further frontward than a front end of the lower sheet guide 88.

The front end of the upper sheet guide 87 is adjacent to the photosensitive cartridge 51 which constitutes a lower portion of the process cartridge 50. The upper sheet guide 87 includes a reinforcing rib 87A which protrudes upward and extends in the width direction. The reinforcing rib 87A is adjacent and opposite to a wall portion 96A which extends downward from an inner face of the upper cover 96. The upper cover 96 covers the upper frame 86 and the cover portion 89 of the fixing unit 80. As shown in FIG. 3, the upper sheet guide 87 includes guide slopes 87B, 87B formed on a lower face and at opposite end portions in the width direction so as to guide opposite corners in the width direction of the recording sheet P.

As shown in FIGS. 4 and 5, the lower sheet guide 88 is disposed below the upper sheet guide 87 so as to face the upper sheet guide 87. The lower sheet guide 88 comprises a front portion of a first sheet guide 88A and a second sheet guide 88B. The second sheet guide 88B is disposed behind and extends from the front portion of the first sheet guide 88A.

A recess 88C is formed by the front portion of the first sheet guide 88A and a front end portion of the second sheet guide 88B so as to receive a curved portion of the recording sheet P. The second sheet guide 88B includes a inclined guide portion 88D which extends diagonally upward and rearward from the recess 88C so as to guide the recording sheet P toward a nip portion between the heat roller 81 and the pressure roller 82.

<Advantages of Fixing Unit>

In the color printer 1 as an image forming apparatus according to the above-described embodiment, the cover portion 89 of the fixing unit 80 covers the upper portion of the noncontact thermistor 85, and the upper frame 86 of the fixing unit 80 covers the upper and front portions of the heat roller 81. Furthermore, the upper sheet guide 87 extends frontward from the front end of the upper frame 86. Such a structure suppresses air flow in an air layer between the heat roller 81 and the noncontact thermistor 85 when the exhaust fan 84 operates and generates air flow to cool the right end portion of the heat roller 81. Accordingly, the noncontact thermistor 85 is allowed to detect the temperature of the heat roller 81 stably.

The exhaust fan 84 for cooling the heat roller 81 is single in number and is disposed on the right end portion of the heat roller 81 in the axial direction and below and slightly rearward of the heat roller 82. In addition, the upper sheet guide 87 disposed frontward of the heat roller 81 is below the axis of the heat roller 81, which is below the noncontact thermistor 85, and above the exhaust fan 84. The upper sheet guide 87 reduces air flow in the vicinity of the noncontact thermistor 85 during operation of the exhaust fan 84. Accordingly, the noncontact thermistor 85 is allowed to detect the temperature of the heat roller 81 stably.

The upper sheet guide 87 extends from the upper frame 86 toward an upstream side in the conveying direction of the recording sheet P, and the lower sheet guide 88 is disposed below the upper sheet guide 87 to face the upper sheet guide 87. Thus, the upper sheet guide 87 and the lower sheet guide 88 guide the recording sheet P smoothly toward the heat roller 81 and the pressure roller 82.

At this time, the inclined guide portion 88D behind the lower sheet guide 88 conveys the recording sheet P smoothly toward the nip portion between the heat roller 81 and the pressure roller 82. Even when the recording sheet P curls relative to the width direction, the guide slopes 87B, 87B formed on the lower face of the upper sheet guide 87 guide the opposite corners of the recording sheet P in the width direction to help smooth conveyance of the recording sheet P.

Particularly, the upper sheet guide 87 protrudes further frontward than the front portion 88A of the lower sheet guide 88. This further suppresses air flow in the air layer between the heat roller 81 and the noncontact thermistor 85 and allows the noncontact thermistor 85 to detect the temperature of the heat roller 81 more stably. In addition, the upper sheet guide 87 which protrudes frontward guides an upper side of the recording sheet P, even when it curls relative to the width direction, and helps smooth conveyance of the recording sheet P toward the heat roller 81 and the pressure roller 82.

The speed at which the recording sheet P is conveyed by the transfer unit 70 toward the fixing unit 80 is usually set slightly higher than the speed at which the recording sheet P is conveyed from the fixing unit 80 toward the sheet discharge unit 90. Thus, the recording sheet P conveyed by the transfer unit 70 toward the fixing unit 80 is likely to sag downward. To cope with this, the recess 88C is formed between the front portion 88A of the lower sheet guide 88 and the inclined guide portion 88D. The recess 88C receives the recording sheet P while allowing the sheet P to sag, thereby to prevent jamming of the sheet P between the heat roller 81 and the pressure roller 82.

The upper sheet guide 87 includes the reinforcing rib 87A which protrudes upward and extends in the width direction. The reinforcing rib 87A prevents the upper sheet guide 87 from warping in the up-down direction. Thus, the recording sheet P is smoothly guided into a clearance, which is maintained unchanged, between the upper sheet guide 87 and the lower sheet guide 88.

The reinforcing rib 87A is adjacent and opposite to the wall portion 96A which extends downward from the inner face of the upper cover 96. This further suppresses air flow toward the heat roller 81 which may be generated by the operation of the exhaust fan 84. In addition, as shown in FIG. 1, the front end of the upper sheet guide 87 is adjacent to the photosensitive cartridge 61. This suppresses air from flowing between the photosensitive cartridge 51 and the upper sheet guide 87 toward the inside of the fixing unit frame 83 where the heat roller 81 is disposed. Consequently, turbulence of the air layer between the heat roller 81 and the noncontact thermistor 85 is further suppressed.

In the color printer 1 as an image forming apparatus according to an embodiment of the invention, the noncontact thermistor 85 as a noncontact temperature sensor is allowed to stably detect the surface temperature of the heat roller 81 as a heating member because air flow in the air layer between the heat roller 81 and the noncontact thermistor 85 is suppressed.

Although, in the above-described embodiment, the image forming unit 30 of the color printer 1 comprises the four process cartridges 50 and the transfer unit 70 for the four process cartridges, an image forming unit may comprise only a single process cartridge and a single transfer unit for the process cartridge.

Alternatively to the fixing unit 80, a fixing unit may comprise a heat roller, a fixing roller, and an endless belt winding around the heat roller and the fixing roller, or may comprise a film type heating rotary body around which an endless fixing film is rotated. A pressure member to be pressed against the heating rotary body may not necessarily be a rotatable roller and may be a plate-shaped member.

Although, in the above-described embodiment, the recording sheet P, such as thick paper, thin paper, and a postcard, is taken as an example of a recording sheet, a recording sheet may be an overhead projector (OHP) sheet.

Alternatively to the color printer 1, an image forming apparatus may be a monochrome printer, a copier, a multi-function device, etc.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. An image forming apparatus comprising:

a heating member configured to heat a recording sheet;

a pressuring member disposed below the heating member and configured to press the recording sheet against the heating member;

a fixing unit frame supporting the heating member and the pressuring member;

an upper frame covering an upper portion of the heating member and an upstream portion of the heating member in a conveying direction of the recording sheet, the upper frame defining an air trap for trapping air heated by the heating member;

a noncontact temperature sensor disposed in the air trap and facing the heating member, the noncontact temperature sensor being configured to detect a temperature of the heating member without contacting the heating member;

an upper sheet guide which has a plate shape, wherein the upper sheet guide protrudes from an upstream end, in the conveying direction, of the upper frame in an upstream direction opposite to the conveying direction, and extends in a width direction perpendicular to the conveying direction and to a vertical direction;

a lower sheet guide disposed below and facing the upper sheet guide, the upper sheet guide and the lower sheet guide being configured to guide the recording sheet in the conveying direction toward the heating member and the pressuring member, a sheet discharge unit disposed downstream of the heating member in the conveying direction and configured to discharge the recording sheet heated by the heating member along a sheet discharge path; and an exhaust fan disposed below the heating member and at an end of the heating member in the width direction, the exhaust fan and the upper frame being configured such that the exhaust fan exhausts air out of the image forming apparatus along the sheet discharge path while the air heated by the heating member remains trapped in the air trap where the noncontact temperature sensor is disposed.

2. The image forming apparatus according to claim 1, wherein the upper sheet guide protrudes further in the upstream direction than the lower sheet guide.

3. The image forming apparatus according to claim 1, wherein the lower sheet guide comprises:

a recess configured to receive a sag of the recording sheet, and an inclined guide extending downstream in the conveying direction and diagonally upward from the recess, and configured to guide the recording sheet into a position between the heating member and the pressuring member.

4. The image forming apparatus according to claim 1, wherein the upper sheet guide comprises a reinforcing rib extending along the width direction and protruding upward.

5. The image forming apparatus according to claim 4, further comprising an upper cover covering the upper frame and including a wall portion extending downward to be adjacent and opposite to the reinforcing rib of the upper sheet guide.

6. The image forming apparatus according to claim 1, wherein the heating member comprises a roller, and the upper sheet guide is disposed below a rotational axis of the roller.

7. The image forming apparatus according to claim 1, wherein the upper sheet guide is disposed below the noncontact temperature sensor and above the exhaust fan.

8. The image forming apparatus according to claim 1, further comprising a process cartridge including an image bearing member and removably disposed such that a downstream end of the process cartridge is adjacent to an upstream end of the upper sheet guide in the conveying direction.

9. The image forming apparatus according to claim 1, wherein the upper sheet guide comprises a pair of guide slopes formed at opposite end portions of a lower face thereof in the width direction and configured to guide opposite corners of the recording sheet in the width direction.

10. The image forming apparatus according to claim 1, wherein the noncontact temperature sensor is disposed at a central portion of the fixing unit frame in the width direction.

11. The image forming apparatus according to claim 10, wherein the upper frame comprises:

a center segment disposed facing the noncontact temperature sensor such that the noncontact temperature sensor is interposed between the center segment and the heating member in the vertical direction, and a side segment disposed on each side of the center segment in the width direction and extending along the width direction.

12. The image forming apparatus according to claim 5, wherein the upper cover defines a part of a discharge path along which the recording sheet conveyed between the heating member and the pressuring member is discharged out of the image forming apparatus.

13. The image forming apparatus according to claim 1, wherein the upper sheet guide includes a fixed end connected to the upper frame and a free end opposite to the fixed end, and wherein the free end of the upper sheet guide extends toward a process cartridge receiving portion of the image forming apparatus in the upstream direction.

* * * * *